US005244050A

United States Patent [19]

Estes

[11] Patent Number: 5,244,050

[45] Date of Patent: Sep. 14, 1993

[54] ROCK BIT WITH OFFSET TOOL PORT

[75] Inventor: Roy D. Estes, Weatherford, Tex.

[73] Assignee: Rock Bit International, Inc., Fort Worth, Tex.

[21] Appl. No.: 840,810

[22] Filed: Apr. 6, 1992

[51] Int. Cl.[5] ..... E21B 10/00

[52] U.S. Cl. ..... 175/393

[58] Field of Search ..... 175/393, 417, 418, 424, 175/337-340

[56] References Cited

U.S. PATENT DOCUMENTS 2,086,682 7/1937 Scott .
3,007,750 11/1961 Cunningham .
3,137,354 6/1964 Crawford et al. .
3,329,222 7/1967 Neilson .
4,287,957 9/1981 Evans ..... 175/339 X
4,397,363 8/1983 Fuller .
4,619,335 10/1986 McCullough ..... 175/339
4,886,131 12/1989 Cholet et al. ..... 175/393 X

*Primary Examiner*—Thuy M. Bui
*Attorney, Agent, or Firm*—Arnold, White & Durkee

[57] ABSTRACT

An earth boring drill bit having a relatively large tool passage port offset to one side of the bit centerline. The port is offset to permit substantially full bottom hole coverage of the cutting structure. The port permits various logging and sampling tools to pass through the bit to allow sampling and testing to be performed without tripping out the drill string.

16 Claims, 3 Drawing Sheets

ROCK BIT WITH OFFSET TOOL PORT

FIELD OF INVENTION

This invention relates in general to earth boring bits and in particular to the type bits used for drilling oil wells. This invention is effective as both fixed cutter and rotary cone cutter bits. Bits of this type are suspended downwardly on drilling pipe from a drilling rig. The drilling rig normally supplies rotational energy to the drilling pipe, controls the amount of drill pipe weight resting on the bit and forces drilling fluid through the drill pipe and bit for cooling and cleaning. Rotational energy is sometimes supplied to the bit by a downhole mud motor.

In conventional application the drill pipe is periodically removed from the borehole so the dulled bit can be replaced with a sharp one. In oil field applications the drill pipe is also often removed to permit various testing and logging procedures. Some specialized tools for testing and/or logging go in and out of the borehole attached to the drill pipe and some go in and out by means of wireline.

BACKGROUND OF INVENTION

This invention was conceived in response to a drilling problem encountered by ODP. The ODP (Ocean Drilling Program) is an international scientific project which bores into the ocean floors and retrieves cores for geologic research. Some areas of ocean floor lava flows have been very difficult to bore and core into because of the brittle hard and broken nature of the deposits. The walls of boreholes formed in this material are very unstable. The borehole walls would almost always collapse and fill the hole whenever the drill pipe and bit were removed. Sometimes the walls would collapse on the drill pipe and bit permanently locking them in the formation. In this situation cores and samples have not been obtained below the depth which one bit can penetrate. In order to penetrate deeper in these formations it was decided to drill a first bit and drill pipe into the formation, detach from the drill pipe and leave it embedded in the formation for use as a conduit or cased hole. A smaller second drill string and bit will then pass through the previous ones and drill into deeper sections of the formation. The first bit had to permit a four inch diameter bit to pass through it and the overall diameter of the first bit had to be kept to a minimum. Several concepts for the first bit have been suggested including both fixed cutter and rolling cutter designs. One of the rolling cutter concepts is an embodiment of this invention.

As mentioned earlier it is often necessary to trip the drill pipe out of oil wells to permit testing of various sorts. These tests include taking cores, taking fluid samples, measuring formation pore pressure, taking electric logs etc . . . Many of these tests are accomplished with tools which are lowered into the hole and retrieved by means of cables or wireline systems. The wireline systems can move the tools in and out of the holes at several hundreds of feet per minute. Tripping drill pipe usually requires about one hour per 1000 ft. of depth. The cost per hour of land drilling rigs averages from 300 to 500 dollars per hour and for offshore rigs the averages are from 1000 to 2500 dollars per hour. Therefore on a 10,000 ft. oil well the trip cost alone for testing can range from 3,000 to 25,000 dollars. There is a need for oil field bits which can perform competitively with current bits and permit certain downhole testing without having to be tripped out.

OBJECTIVE OF THE INVENTION

An object of this invention is to provide an improved rotary cone cutter bit which has a minimal overall diameter and will permit a secondary drill string and bit to pass through it.

Another object of this invention is to provide an improved rotary cone cutter bit which will permit certain testing tools to pass through it.

Another object of this invention is to provide an improved fixed cutter bit which will permit certain testing tools to pass through it.

BRIEF DESCRIPTION OF THE DRAWINGS

1. Sectional view of a rolling cone bit, built in accordance with the principles of this invention.
2. Bottom view of the bit in FIG. 1.
3. Sectional view of an 8½" oil field rolling cone cutter bit built in accordance with this invention.
4. Bottom view of the bit in FIG. 4.
5. Sectional view of an 8½" oil field fixed cutter bit built in accordance with this invention.
6. Bottom view of the bit in FIG. 5.

DESCRIPTION OF MAJOR EMBODIMENTS

Figure 2:
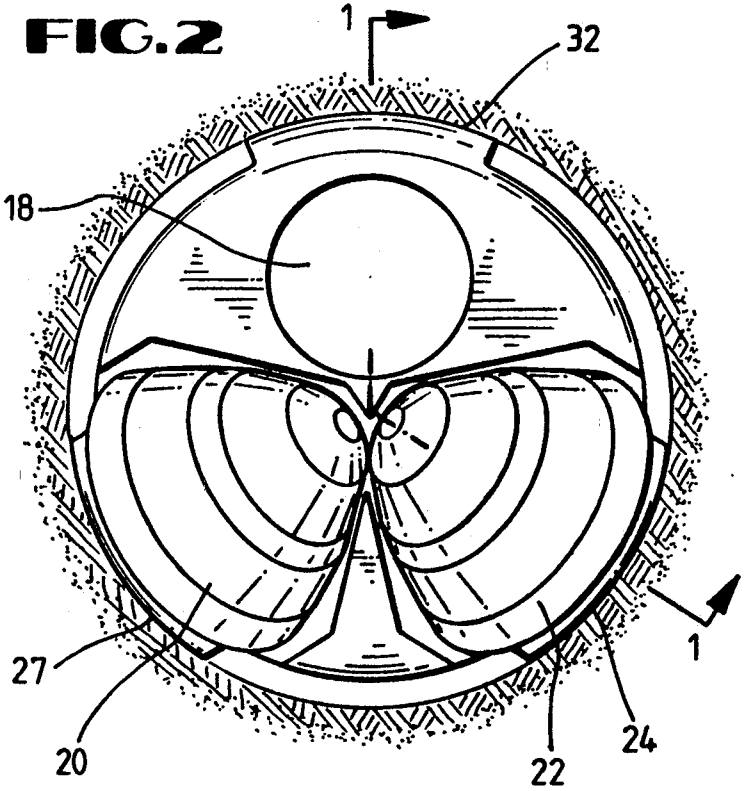
Figure 1:
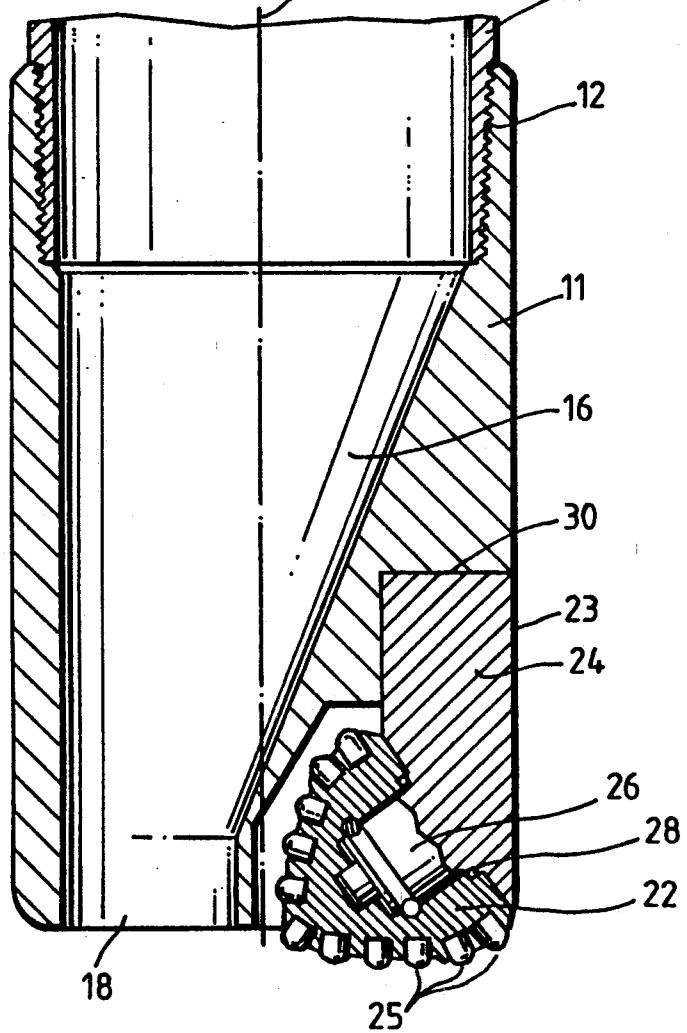

FIGS. 1 and 2 are based on a design for an 11½ inch diameter casing bit having a 4" port eccentric or offset from the centerline 15 of the bit. The body 11 has a box connection 12 and is connected to a casing pipe 14. In this configuration the casing pipe 14 forms the lower portion of the drill string. The top of the body cavity 16 is as large as the casing 14 ID. This cavity 16 diminishes in diameter and is skewed one side as it traverses the length of the body to the cutting end of the bit. The exit port 18 is offset to one side in order to prevent a tool passing through it from being damaged by the rolling cone cutters 20 and 22. The shape of the body cavity 16 acts as a guide to direct any tool to the port 18. In this embodiment the side of the body cavity 16 forms about a 15 degree ramp to force any incoming tool to the port. In another embodiment (not shown) a 20 foot long casing joint just above the bit contained an inner pipe which was centralized at the upper end and skewed to match the port on the lower end. This provided a very long and gradual slope to the port.

Borehole is formed as the two rolling cone cutters 20 and 22 are rotated forcibly against the formation. The cutters are equipped with tungsten carbide inserts (TCI) 25 and are mounted on journal segments 24 and 27. TCI cutters are used for illustration only steel tooth cutters can also be effective depending on the formation being drilled. Typically the cone and journal bearing system 26 is sealed with o-rings 28 and has lubrication and pressure equalization systems (not shown). The journal segments or legs 24 are welded in pockets 30 formed in the body 11. A stabilizer pad 32 is formed opposite to the cone cutters to insure the bit drills a full gage hole. In this configuration the outermost surfaces 23 of the segments 24 and 27 also form stabilizer pads. All the drilling fluid for removing detritus and cooling the bit flow through the port 18.

The above embodiment was conceived to address a specific need for drilling and coring scientific holes in hard broken basalt. The basic concept of a bit that can efficiently drill earth formations and permit tools to pass through it also has application in the oil field.

Figure 4:
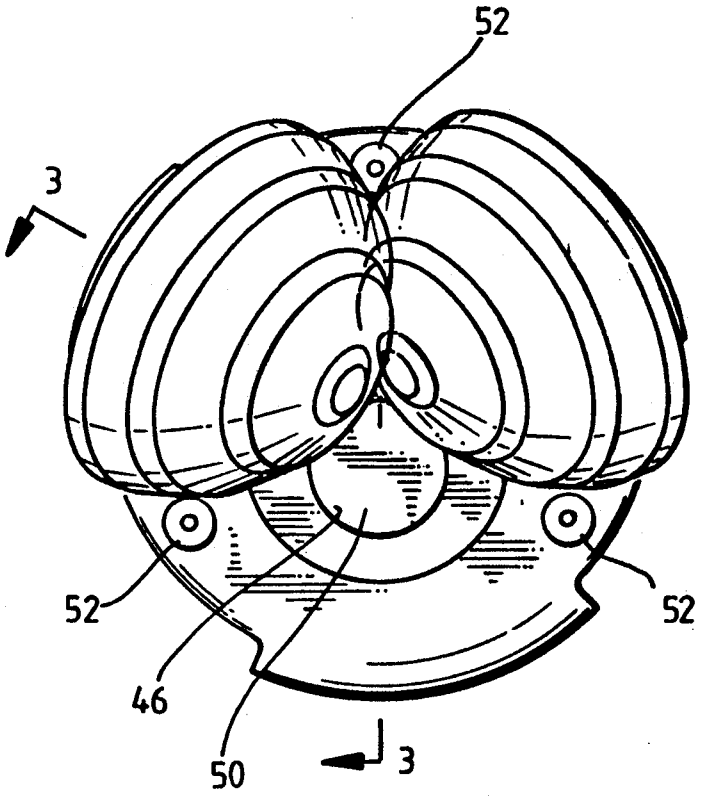
Figure 3:
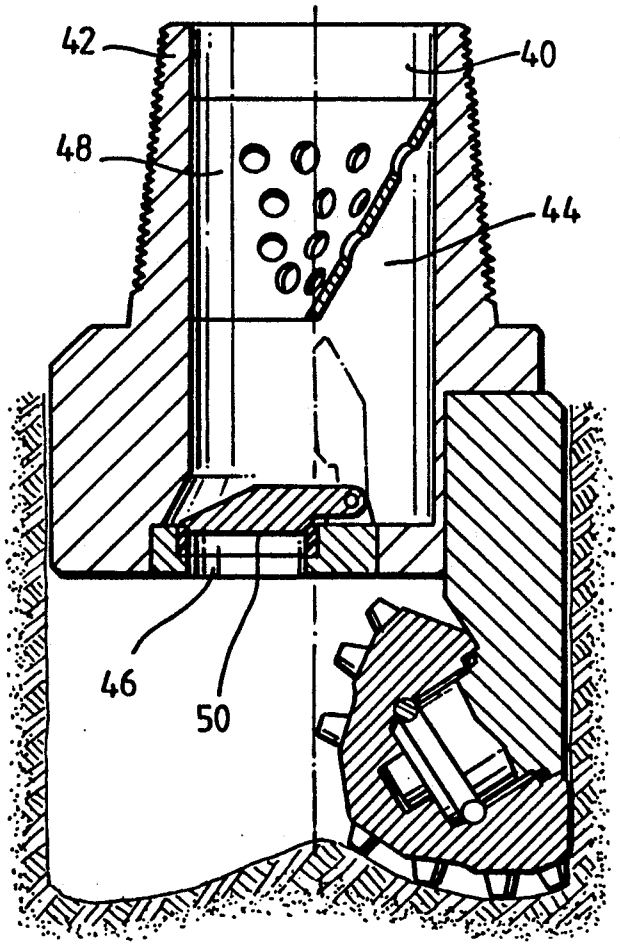

FIGS. 3 and 4 show another two cone rolling cutter TCI rock bit embodying this invention. The proportions of bit 40 are relative to a bit which would drill an 8½ inch borehole, a common oil field size. The pin 42 shown is a 6⅝ API pin such as is used on 9⅞" diameter and larger bits. The large pin 42 can have a large enough bore to permit passage of a 1½" diameter long rigid tool through the offset tool passage port 46. A screen or baffle 48 is used to guide any tool through the port. The screen 48 will not unduly restrict the flow of drilling fluid during drilling. In this embodiment the eccentric port 46 has a hinged spring loaded closure 50 (spring not shown) which opens whenever drilling fluid stops flowing through the bit. During the drilling mode the flow of fluid forces the closure valve 50 shut and allows the fluid to pass through the jets 52 at normal pressures. The open position of the closure 50 is shown in phantom line.

Figure 6:
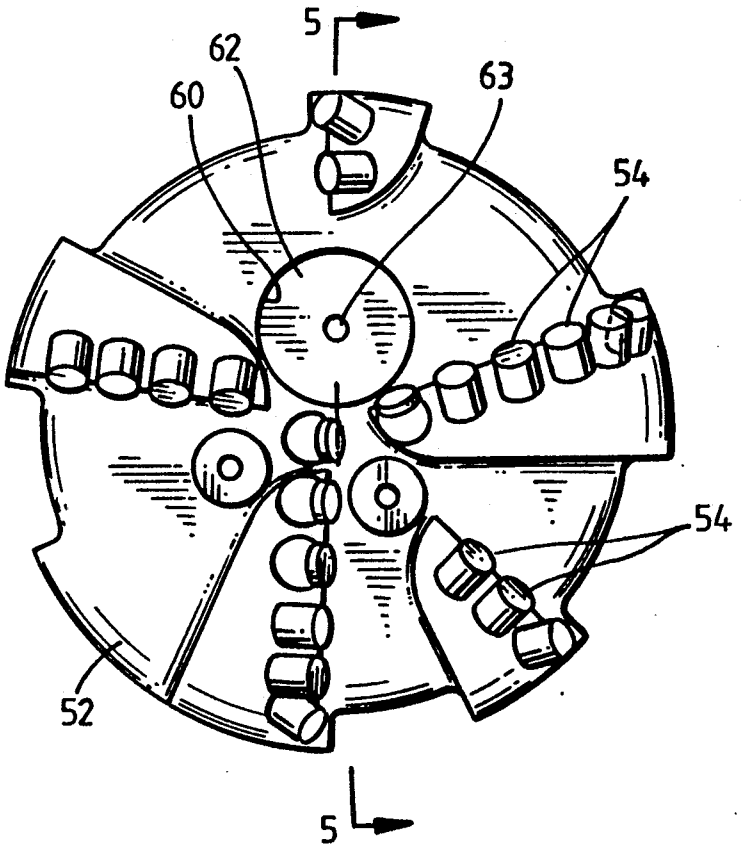
Figure 5:
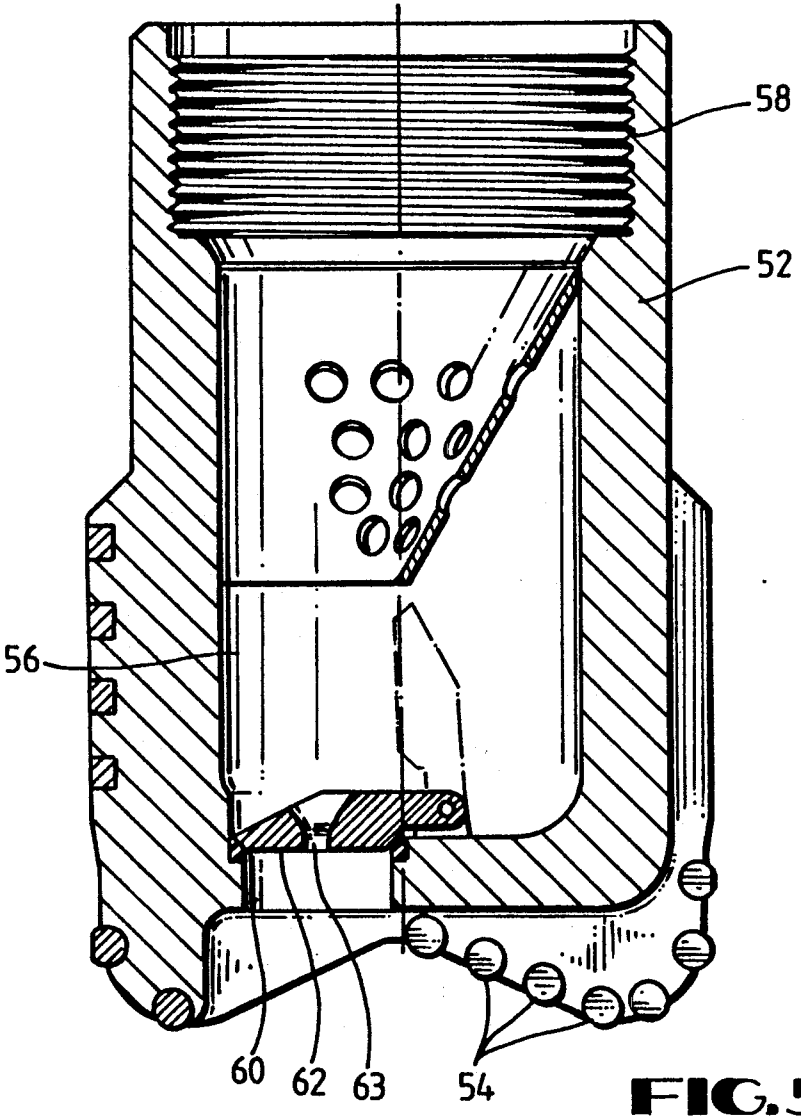

FIGS. 5 and 6 show a drag type oil field bit embodying this invention. Bit 52 forms borehole as polycrystalline diamond compacts (PDC's) 54 scrape away formation. A PDC cutting structure is used representative of fixed cutter bits, cutting structures of natural diamond or of TSD (Thermally Stable Diamond) are equally useful depending on the formation being drilled. This type bit adapts easily to a large diameter bore 56 and box connection 58 allowing a large eccentric port 60. FIGS. 5 and 6 are based on an 8½" diameter bit and show that an eccentric port 60 with a 2 inch or larger diameter can be used with relatively standard placement of the PDC's 54. In this illustration the port closure 62 has a jet port 63 built into it. This permits the bit to operate in the drilling mode as if the port was just another jet.

Use of long rigid tools with bits like these would probably require that the drill pipe immediately above the bit have a larger than normal bore diameter to permit the tool to align with the eccentric port. Bits smaller than 9⅞" diameter built according to this invention will need larger bores than normally are used on prior art bits. This will require large pin connections or box connections.

It is possible to drill some oil field formations with bits having only one rotatable cone. This invention can be configured with one or more rotating cones. Different means can be used to provide closure of eccentric ports other than what is shown including sliding devices, tethered buoyant devices, spring tethered devices etc . . . The port could also be closed by a means which would require use of a wireline device to open and reclose the port. A functional or operative port is one which permits use of testing tools through the port and also provides adequate control of the drilling fluid to insure proper removal of cuttings and cooling of the bit during drilling. An operative port may or may not require closure means depending on the operating conditions, formation and design of the bit.

There are wireline tools which can take core samples and fluid samples horizontally from the side wall of a borehole. It is anticipated that such devices can be adapted to operate vertically through the offset port in a bit built according to this current invention to take samples from the borehole bottom. It is also anticipated that such devices can be adapted to reside in a modified bit body or sub assembly installed above the bit so that samples can be taken through the bit on demand at any time during the drilling of a well. This latter embodiment using a modified bit body or sub assembly would permit sampling or testing to take place below a downhole mud motor and/or MWD system (monitoring while drilling).

Many variations of the invention shown here can be designed by those skilled in the art without departing from the spirit thereof.

I claim:

1. An improved roller cone rock drill bit comprising:

a bit body, said bit body having on its upper end a means for connecting said bit to a drill string;

one or more cone cutters, each cone cutter being rotatably mounted on a journal segment that extends from the lower end of said bit body;

a passageway that traverses the length of said bit body; and a tool passage port connected to the lower end of said passageway, said tool passage port being offset from the centerline of said drill bit and being of sufficient diameter to allow passage of a tool through said drill bit.

2. The improved roller cone rock drill bit of claim 1 wherein said tool is a second drill bit.

3. The improved roller cone rock drill bit of claim 1 wherein said tool is an apparatus for testing formations below said drill bit.

4. The improved roller cone rock drill bit of claim 1 wherein said passageway includes a guide for directing tools to said tool passage port.

5. The improved roller cone rock drill bit of claim 1 further comprising closure means for said tool passage port, said closure means being operative in its closed position to divert fluid circulation through one or more jets in said drill bit, and being operative in its open position to allow passage of a tool through said tool passage port.

6. The improved roller cone rock drill bit of claim 5 wherein said closure means includes one or more jets for fluid circulation through said closure means when said closure means is in its closed position.

7. The improved roller cone rock drill bit of claim 5 wherein said closure means is a hinged spring loaded valve, said valve closes when fluid circulates through said bit and opens when fluid circulation steps.

8. An improved fixed cutter drill bit comprising:

a bit body, said bit body having on its upper end a means for connecting bit to a drill string;

one or more fixed cutters on the face of said drill bit;

a passageway that traverses the length of said bit body; and a tool passage port connected to the lower end of said passageway, said tool passage port being offset from the centerline of said drill bit and being of sufficient diameter to allow passage of a tool through said drill bit.

9. The improved fixed cutter drill bit of claim 8 wherein said tool is a second drill bit.

10. The improved fixed cutter drill bit of claim 8 wherein said tool is an apparatus for testing formations below said drill bit.

11. The improved fixed cutter drill bit of claim 8 wherein said passageway includes a guide for directing tools to said tool passage port.

12. The improved fixed cutter drill bit of claim 8 further comprising closure means for said tool passage port, said closure means being operative in its closed position to divert fluid circulation through one or more jets in said drill bit, and being operative in its open position to allow passage of a tool through said tool passage port.

13. The improved fixed cutter drill bit of claim 12 wherein said closure means includes one or more jets for fluid circulation through said closure means when said closure means is int its closed position.

14. The improved fixed cutter drill bit of claim 12 wherein said closure means is a hinged spring loaded valve, said valve closes when fluid circulates through said bit and opens when fluid circulation stops.

15. An improved method of drilling comprising the steps of:

drilling a borehole with a primary drillstring and drill bit;

leaving said drill bit and at least a portion said primary drillstring in the borehole;

running a second bit on a secondary drillstring through said portion of said primary drillstring and said drill bit; and drilling a second borehole with said second drill bit.

16. An improved method of testing geological formation comprising the steps of:

running test tools through a drillstring in a borehole;

passing said test tools through a tool passage port in a drill bit, said drill bit being connected tot he distal end of said drillstring; and testing geological formations beneath said drill bit with said test tools.

* * * * *